US008786214B2

(12) United States Patent
Oshima et al.

(10) Patent No.: US 8,786,214 B2
(45) Date of Patent: Jul. 22, 2014

(54) LIGHT EMITTING ELEMENT DRIVE DEVICE AND LIGHTING DEVICE

(71) Applicant: TDK Corporation, Tokyo (JP)

(72) Inventors: Kazunori Oshima, Tokyo (JP); Hironobu Masuoka, Tokyo (JP); Mitsuyuki Tsujisaka, Tokyo (JP); Yukiharu Miyaoka, Tokyo (JP)

(73) Assignee: TDK Corporation (JP)

( * ) Notice: Subject to any disclaimer, the term of this patent is extended or adjusted under 35 U.S.C. 154(b) by 99 days.

(21) Appl. No.: 13/706,984

(22) Filed: Dec. 6, 2012

(65) Prior Publication Data

US 2013/0147399 A1 Jun. 13, 2013

(30) Foreign Application Priority Data

Dec. 8, 2011 (JP) ..... 2011-269075

(51) Int. Cl.
*H05B 37/02* (2006.01)

(52) U.S. Cl.
USPC ..... 315/307; 315/360; 315/291; 315/247; 315/224; 363/86; 363/89; 323/241

(58) Field of Classification Search
CPC ..... H05B 37/02; H05B 33/0803; H05B 33/0815; H05B 33/0818; H05B 33/0833; H05B 33/0887; H02M 7/217; H02M 2001/0006; H02M 2001/0032; H02M 2001/0012; Y02B 20/208; Y02B 20/347
USPC ..... 315/291, 247, 224, 294, 297, 307, 360, 315/312, 313, 362; 363/86, 89, 90, 97; 323/239, 241
See application file for complete search history.

(56) References Cited

U.S. PATENT DOCUMENTS

| | | | | |
|---|---|---|---|---|
| 6,269,012 | B1 * | 7/2001 | Kusakabe et al. | 363/84 |
| 6,630,749 | B1 * | 10/2003 | Takagi et al. | 307/10.7 |
| 8,492,987 | B2 * | 7/2013 | Nuhfer et al. | 315/246 |
| 2013/0187570 | A1 * | 7/2013 | Oshima et al. | 315/307 |
| 2013/0207571 | A1 * | 8/2013 | Esaki et al. | 315/297 |

FOREIGN PATENT DOCUMENTS

| | | |
|---|---|---|
| JP | 09-331017 | 12/1997 |
| JP | 2002-172215 | 6/2002 |
| JP | 2002-172215 A5 | 4/2005 |

* cited by examiner

*Primary Examiner* — Haiss Philogene
(74) *Attorney, Agent, or Firm* — Harness, Dickey & Pierce, P.L.C.

(57) ABSTRACT

A light emitting element drive device includes an electric conduction switch that is provided along a power input line, a voltage detection unit that detects a power source voltage containing a noise component when the electric power is supplied to the power input line, a conversion processing unit that converts the detected power source voltage containing the noise component to a digital value, a data generation unit that generates data of a predetermined number of bits, and a control unit that turns on the electric conduction switch. The control unit determines a delay time based on the predetermined number of bits. The delay time corresponds to a time between supplying the electric power to the power input line and turning on the electric conduction switch. The control unit turns on the electric conduction switch after the delay time passes. Thus, an excessive rush current is prevented.

7 Claims, 5 Drawing Sheets

LIGHT EMITTING ELEMENT DRIVE DEVICE AND LIGHTING DEVICE

CROSS-REFERENCE TO RELATED APPLICATION

This application claims priority to Japanese Patent Application No. 2011-269075 filed Dec. 8, 2011 which is hereby expressly incorporated by reference herein in its entirety.

BACKGROUND

The present invention relates to a light emitting element drive device and a lighting device. Specifically, the present invention relates to a light emitting element drive device in which an excessive rush current resulting from supplied electric power can be prevented at the time of performing electric conduction even though electric power is supplied to a plurality of light emitting element drive devices at the same time.

When a plurality of lighting devices are turned ON and OFF (starting and stopping) by a single power supply switch, a rush current flows in a power supply unit inside each of a plurality of light emitting element drive devices at substantially the same time when electric power is applied to each of the light emitting element drive devices inside the lighting devices by turning ON the power supply switch. When the rush current flows in the plurality of light emitting element drive devices at substantially the same time, the aggregated rush current becomes extremely large. Therefore, there are some problems. For example, noise is generated, and switch contacts are deteriorated.

In order to solve the above problems, Japanese Patent Publication No. 2002-172215 discloses a power supply device of an amusement machine in which a rush current can decrease at the time of turning ON the amusement machine. Specifically, when electric power for the amusement machine is applied, the power supply device is configured so as to start sequentially supplying the electric power to a plurality of control devices at intervals of a predetermined time difference.

Further, in Japanese Patent Publication No. H09-331017, when a light emitting element is in an OFF state, electric power for a lighting device is applied. Thereafter, the light emitting element is turned ON by supplying a driving signal for lighting. In other words, after the electric power is applied to a plurality of lighting devices at the same time, a plurality of light emitting elements in the lighting devices are sequentially turned ON by being supplied the driving signal for lighting at intervals of a predetermined time difference. As a result, the rush current can decrease.

As discussed above, when the turning ON and OFF (starting and stopping) operations of a plurality of lighting devices are performed by a single power supply switch, the overcurrent protective device shown in Japanese Patent Publication No. H09-331017 can be used to decrease the rush current at the time of applying the electric power. Specifically, the plurality of light emitting elements in the lighting devices are sequentially turned ON by being supplied the driving signal for lighting at the intervals of the predetermined time difference. Further, a delay circuit and an electric conduction switch that becomes operable to supply electric power by the delay circuit are provided at each power supply device for the light emitting element drive devices of the lighting devices. After the electric power is applied, the electric power is actually supplied by turning ON the electric conduction switch after a delay that is configured by the delay circuit. Thus, the time of lighting the lighting devices is changed.

However, when the lighting devices are turned ON by the driving signal for lighting at the intervals of the predetermined time difference shown in Japanese Patent Publication No. H09-331017, it is necessary to separately provide the control device that generates the driving signal for lighting. Because the control device controls each of the lighting devices, the configuration of the lighting devices becomes complicated.

Further, because the power supply device shown in Japanese Patent Publication No. 2002-172215 is configured so as to start sequentially supplying the electric power to the plurality of control devices at the intervals of the predetermined time difference, the configuration of the power supply device becomes complicated. Further, when a large lighting device is configured with a plurality of the same lighting devices, it is necessary to connect the same lighting devices to each other for control. This is difficult because each of the lighting devices has an independent configuration.

Further, when the time of lighting is changed by providing a delay circuit for each of the lighting devices, it is necessary to set a light time for every lighting device. Thus, there is a problem that adding and exchanging lighting devices cannot be easily performed.

SUMMARY

Accordingly, an object of the present invention is to provide a light emitting element drive device and a lighting device in which electric power can be supplied at different times without adjusting a time between starting to supply the electric power and the start of the rush current in each lighting device. This configuration can be realized by starting to supply the electric power based on a delay time that is generated from a noise component that randomly changes even though the electric power is applied to the plurality of lighting devices at the same time.

In order to achieve the above object, a light emitting element drive device according to a first aspect of the present invention includes: a power input line to which electric power is supplied; an electric conduction switch that is provided along the power input line; a voltage detection unit that detects a power source voltage containing a noise component when the electric power is supplied to the power input line; a conversion processing unit that converts the detected power source voltage containing the noise component to a digital value; a data generation unit that generates data of a predetermined number of bits; and a control unit that turns on the electric conduction switch. The control unit determines a delay time based on the predetermined number of bits. The delay time corresponds to a time between supplying the electric power to the power input line and turning ON the electric conduction switch. As such, the control unit turns ON the electric conduction switch after the delay time passes.

In the light emitting element drive device according to the first aspect of the present invention, the conversion processing unit converts the detected power source voltage to the digital value at least two times so as to obtain a plurality of digital values. The data generation unit links a low-order n-bit of each of the plurality of digital values so as to generate the data of the predetermined number of bits, wherein "n" is an integer equal to or greater than 1.

A light emitting element drive device according to a second aspect of the present invention includes: a power input line to which electric power is supplied; an electric conduction switch that is provided along the power input line; a voltage generation unit that includes a semiconductor device and that generates a voltage containing a noise component when the electric power is supplied to the semiconductor device; a conversion processing unit that converts the detected voltage containing the noise component to a digital value; a data generation unit that generates data of a predetermined number of bits; and a control unit that turns ON the electric conduction switch. The control unit determines a delay time based on the predetermined number of bits. The delay time corresponds to a time between supplying the electric power to the power input line and turning ON the electric conduction switch. As such, the control unit turns ON the electric conduction switch after the delay time passes.

In the light emitting element drive device according to the second aspect of the present invention, the conversion processing unit converts the detected voltage to the digital value at least two times so as to obtain a plurality of digital values. The data generation unit links a low-order n-bit of each of the plurality of digital values so as to generate the data of the predetermined number of bits, wherein "n" is an integer equal to or greater than 1.

In the light emitting element drive device according to the second aspect of the present invention, the semiconductor device is a Zener diode.

According to the present invention, even though the electric power is applied to the plurality of lighting devices at the same time, an excessive rush current can be suppressed. This is because there is a time difference between starting to supply the electric power and the start of the rush current in each of the plurality of lighting devices.

Further, according to the present invention, because a value that corresponds to the noise component that is generated at random for determining the delay time for supplying the electric power is used as data (a random number), a delay time is randomly generated for each lighting device. Therefore, when the electric power is applied at the same time to the plurality of lighting devices that have the same configuration, the supply times for the electric power are different. Thus, the rush current can be reduced. Further, because the light emitting element drive devices are configured with the same circuit, it is not necessary to set a lighting time for each of the lighting devices. As a result, adding and exchanging lighting devices can be easily performed.

DESCRIPTION OF EXEMPLARY EMBODIMENTS

A light emitting element drive device according to an embodiment of the present invention is explained with reference to the drawings below. In the light emitting element drive device according to the embodiment of the present invention, a delay time that corresponds to a time difference between the time for applying electric power and the time for supplying the electric power to a lighting device is determined based on a value that corresponds to a noise component that is generated at random. By performing electric conduction based on the determined delay time, a rush current is controlled even when the electric power starts to be supplied to a plurality of lighting devices at the same time.

Configuration of Light Emitting Element Drive Device

Figure 1:
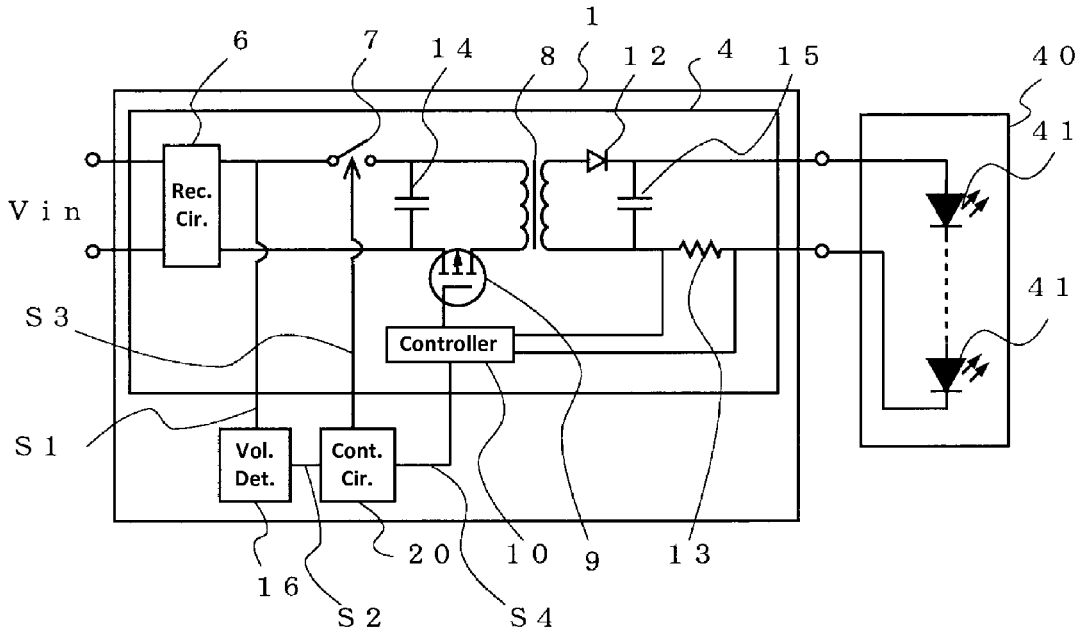
FIG. 1 is a block diagram that shows a configuration of a light emitting element drive device according to an embodiment of the present invention with an insulated type converter used in a power supply unit.
Figure 2:
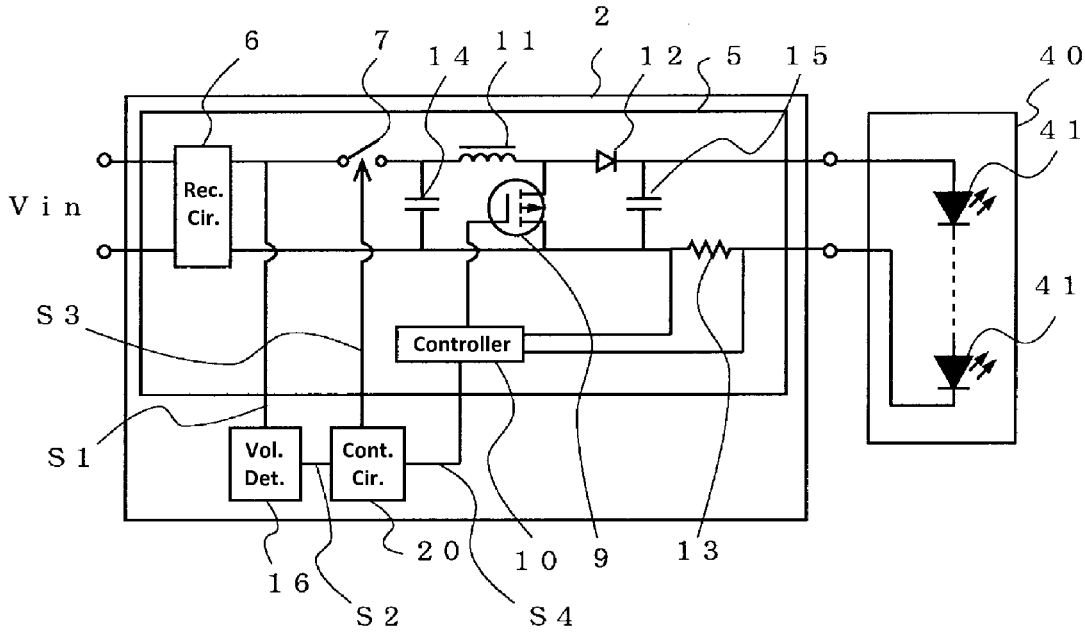
FIG. 2 is a block diagram that shows a configuration of a light emitting element drive device according to an embodiment of the present invention with a non-insulated type converter used in a power supply unit.

FIG. 1 is a diagram that shows a configuration of a light emitting element drive device 1 according to an embodiment of the present invention. In the embodiment of FIG. 1, an insulated type converter is used in a power supply unit. FIG. 2 is a block diagram that shows a configuration of the light emitting element drive device according to another embodiment of the present invention. In the embodiment of FIG. 2, a non-insulated type converter is used in a power supply unit. As shown in FIG. 1, the light emitting element drive device 1 is configured with a power supply unit 4, a voltage detection circuit 16 and a control circuit 20.

The power supply unit 4 is configured with a rectifier circuit 6 that is composed of a diode bridge, a capacitor 14 for smoothing/leveling, a transformer 8, a switching element 9 that is composed of an FET (field effect transistor), a diode 12 that is connected to a secondary side of the transformer 8, a capacitor 15 and a current detection resistor 13. Further, the power supply unit 4 is configured with a controller 10 that performs PWM (pulse width modulation) control of the switching element 9 so as to keep an electric current that flows into a light emitting element part 40 based on a feedback electric current that is detected by the current detection resistor 13. The power supply unit 4 of the light emitting element drive device 1 is an insulated type converter of a flyback type that is configured with the transformer 8, the switching element 9 and the diode 12. Further, an electric conduction switch 7 that performs electric conduction to a positive line between the rectifier circuit 6 and a power source of a flyback type is provided to the power supply unit 4. The electric conduction switch 7 is configured with an electromagnetic relay. Note that the electric conduction switch 7 is not limited to the electromagnetic relay. The electric conduction switch 7 may be a semiconductor such as an FET. Further, electric power is supplied to the power supply unit 4 by a power source Vin shown in FIG. 1.

The voltage detection circuit 16 of the light emitting element drive device 1 detects a voltage S2 that contains a noise component of the power source based on a voltage S1 that is output from the rectifier circuit 6. The control circuit 20 generates data for configuring a delay time based on the voltage S2 that contains the detected noise component in the voltage detection circuit 16. Further, the control circuit 20 controls the electric conduction switch 7 based on the delay time that is generated as discussed above. Turning ON/OFF operations of the electric conduction switch 7 are performed by a signal S3 of the control circuit 20.

As shown in FIG. 1, the light emitting element drive device 1 drives the light emitting element part 40 in which a plurality of light emitting elements 40 such as LEDs are connected in series. The light emitting element drive device 1 and the light emitting element part 40 form a light emitting device that performs such as lighting.

Further, a light emitting element drive device that uses a non-insulated type converter in a power supply unit is shown in FIG. 2. The components shown in FIG. 2 that are the same as those in the light emitting element drive device 1 shown in FIG. 1 are indicated with the same reference numerals. Thus, an explanation about the same configurations is omitted. As shown in FIG. 2, a power supply unit 5 of a light emitting element drive device 2 includes an inductor 11 that accumulates (charges) and releases (discharges) energy by the switching element 9. Thus, the above structures form a non-insulated type converter. The other components of the light emitting element drive device 2 that are shown in FIG. 2 are the same as those in the light emitting element drive device 1 shown in FIG. 1 except for the transformer 8 of the power supply unit 4 shown in FIG. 1.

Configurations of Voltage Detection Circuit and Control Circuit

Figure 3:
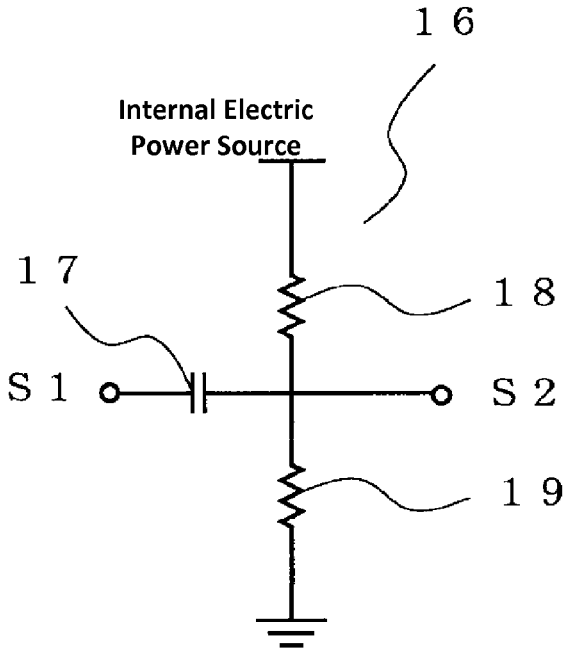
FIG. 3 is a circuit diagram that shows a configuration of a voltage detection circuit for a power source that includes a noise component.

FIG. 3 is a circuit diagram that shows a configuration of a voltage detection circuit for a power source that includes a noise component. As shown in FIG. 3, an internal electric power source is divided by two resistors 18, 19 in the voltage detection circuit 16. A node connected between the resistors 18, 19 is connected to an output of the rectifier circuit 6 through a capacitor 17. The voltage S1 is input to the node of the resistors of 18, 19 through the capacitor 17. Therefore, a high frequency wave, which is the noise component included in the output of the rectifier circuit 6, is overlapped with the voltage S2 of the node of the resistors of 18, 19. The value of the voltage S2 with which the noise component is overlapped is converted from an analog value into a digital value by an A/D converter 22 (shown in FIG. 4) of the control circuit 20.

Figure 4:
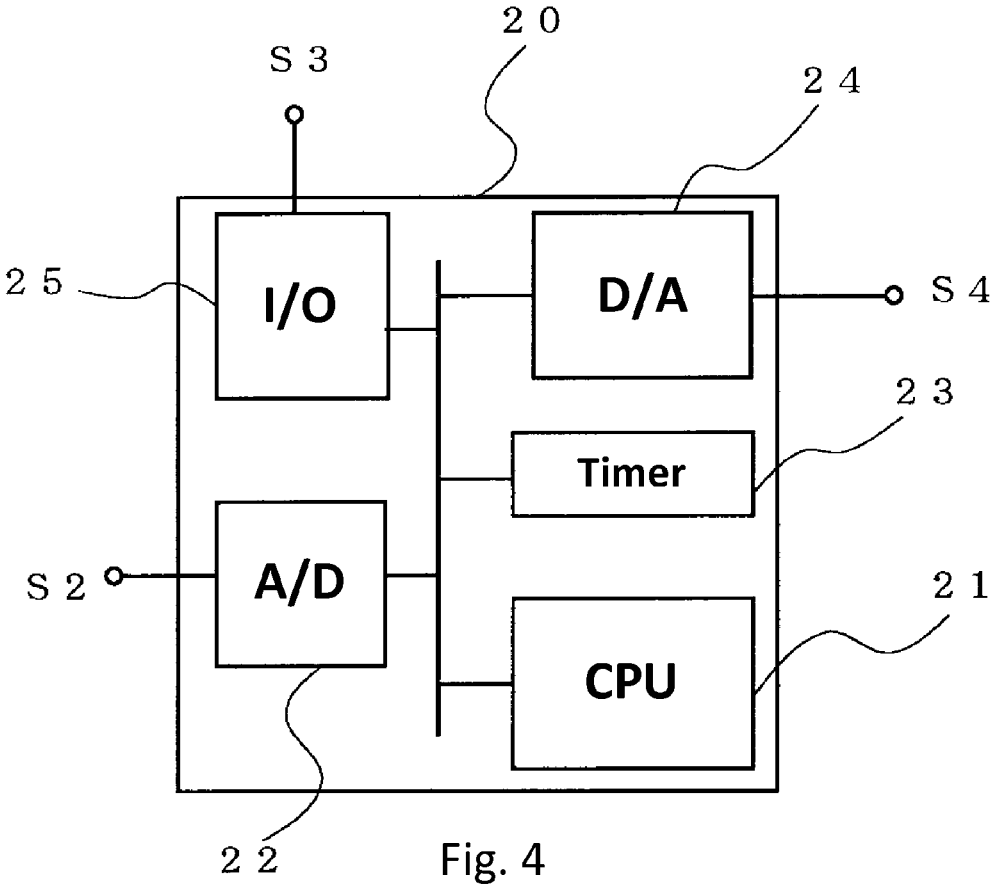
FIG. 4 is a block diagram that shows a configuration of a control circuit.

FIG. 4 is a block diagram that shows a configuration of the control circuit 20. As shown in FIG. 4, the control circuit 20 is configured with a microcomputer. The microcomputer is configured with a CPU 21, the A/D converter 22 (shown as A/D in FIG. 4), a D/A converter 24 (shown as D/A in FIG. 4), a timer 23 and an input and output part 25 (shown as I/O in FIG. 4). The microcomputer as the control circuit 20 has a memory (not shown in FIG. 4) that stores a program. The CPU 21 of the microcomputer executes the program that is stored in the memory. The A/D converter 22 converts a value of the voltage S2 that is detected by the voltage detection circuit 16 from an analog value into a digital value. The timer 23 counts down time data that is set by the CPU 21. When the time data becomes a zero (0) value by counting down with the timer 23, the timer 23 is configured to notify the zero value to the CPU 21. The input and output part 25 outputs the signal S3 that performs the control of the electric conduction switch 7. The D/A converter 24 outputs a target value S4 that is an analog value to the controller 10. The target value S4 is a current that is output to the light emitting element part 40.

Configuration of Voltage Generation Circuit that Generates Noise Component

Figure 5:
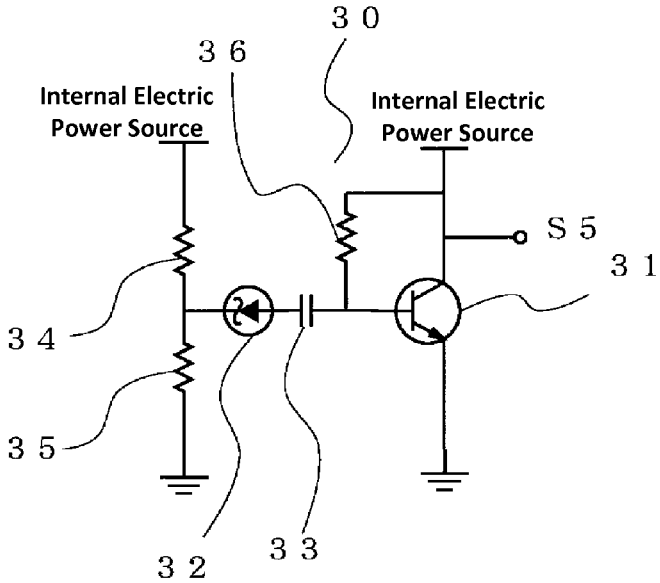
FIG. 5 is a circuit diagram that shows a configuration of a voltage generation circuit that generates a voltage that includes a noise component.

Regarding noise detection, the voltage detection circuit 16 shown in FIG. 3 detects a voltage (power source voltage) of the power source that includes a noise component. However, the present invention is not limited to this configuration. Instead of the noise detection of the power source voltage, a method for detecting white noise that is generated by a Zener diode 32 as a semiconductor device is explained by using FIG. 5. FIG. 5 is a circuit diagram that shows a configuration of a voltage generation circuit 30 that generates a voltage that includes a noise component. As shown in FIG. 5, a transistor 31 is provided in a self-bias state in the voltage generation circuit 30. An anode side of the Zener diode 32 is connected to a base of the transistor 31 through a capacitor 33 in the voltage generation circuit 30. Further, a cathode of the Zener diode 32 is connected to a node connected between resistors 34, 35 that distribute (divide) a voltage of the internal electric power source. In this connection, a voltage between the base and an emitter of the transistor 31 changes due to the white noise that is generated by the Zener diode 32. Due to the change of the voltage between the base and the emitter of the transistor 31, a voltage S5 between a collector and the emitter of the transistor 31 changes. A value of the voltage S5 between the collector and the emitter of the transistor 31 is converted from an analog value into a digital value by the A/D converter 22 of the control circuit 20.

Figure 6:
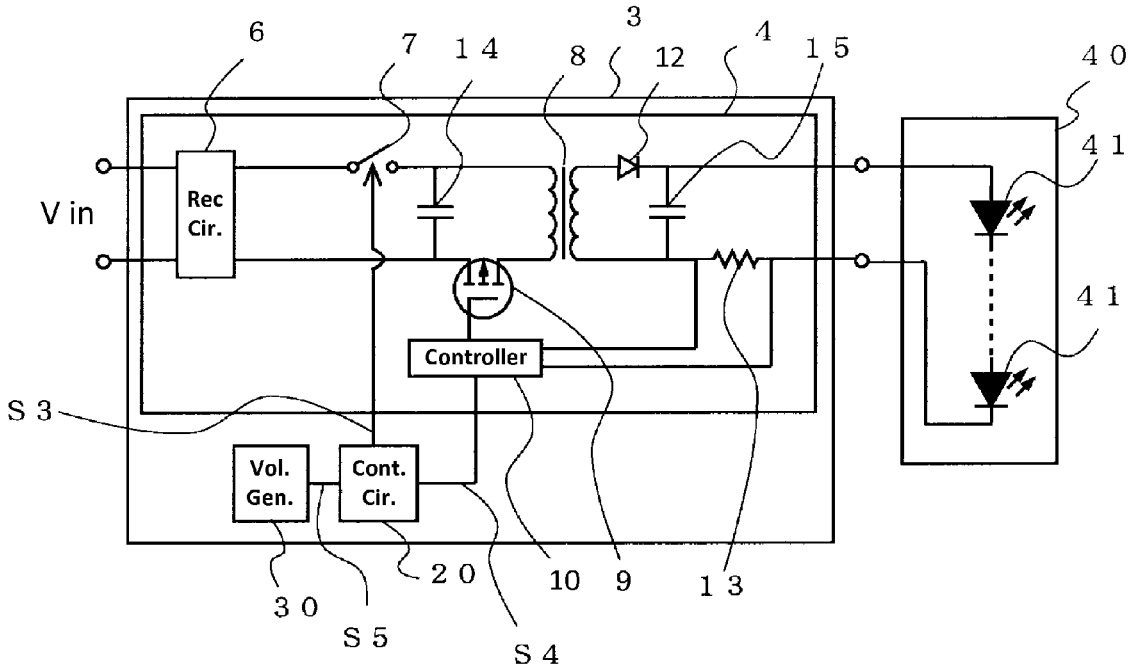
FIG. 6 is a block diagram that shows a configuration of a light emitting element drive device according to an embodiment of the present invention that uses the voltage generation circuit shown in FIG. 5.

FIG. 6 is a block diagram that shows a configuration of a light emitting element drive device 3 according to an embodiment of the present invention that uses the voltage generation circuit 30 shown in FIG. 5. As shown in FIG. 6, the light emitting element drive device 3 has the voltage generation circuit 30 instead of the voltage detection circuit 16 of the light emitting element drive device 1 shown in FIG. 1. Other components shown in FIG. 6 are the same as FIG. 1. Further, the light emitting element drive device 2 that uses the non-insulated type converter in the power supply unit 5 shown in FIG. 2 can also use the voltage generation circuit 30 instead of the voltage detection circuit 16.

Control of Electric Conduction Switch

Figure 7:
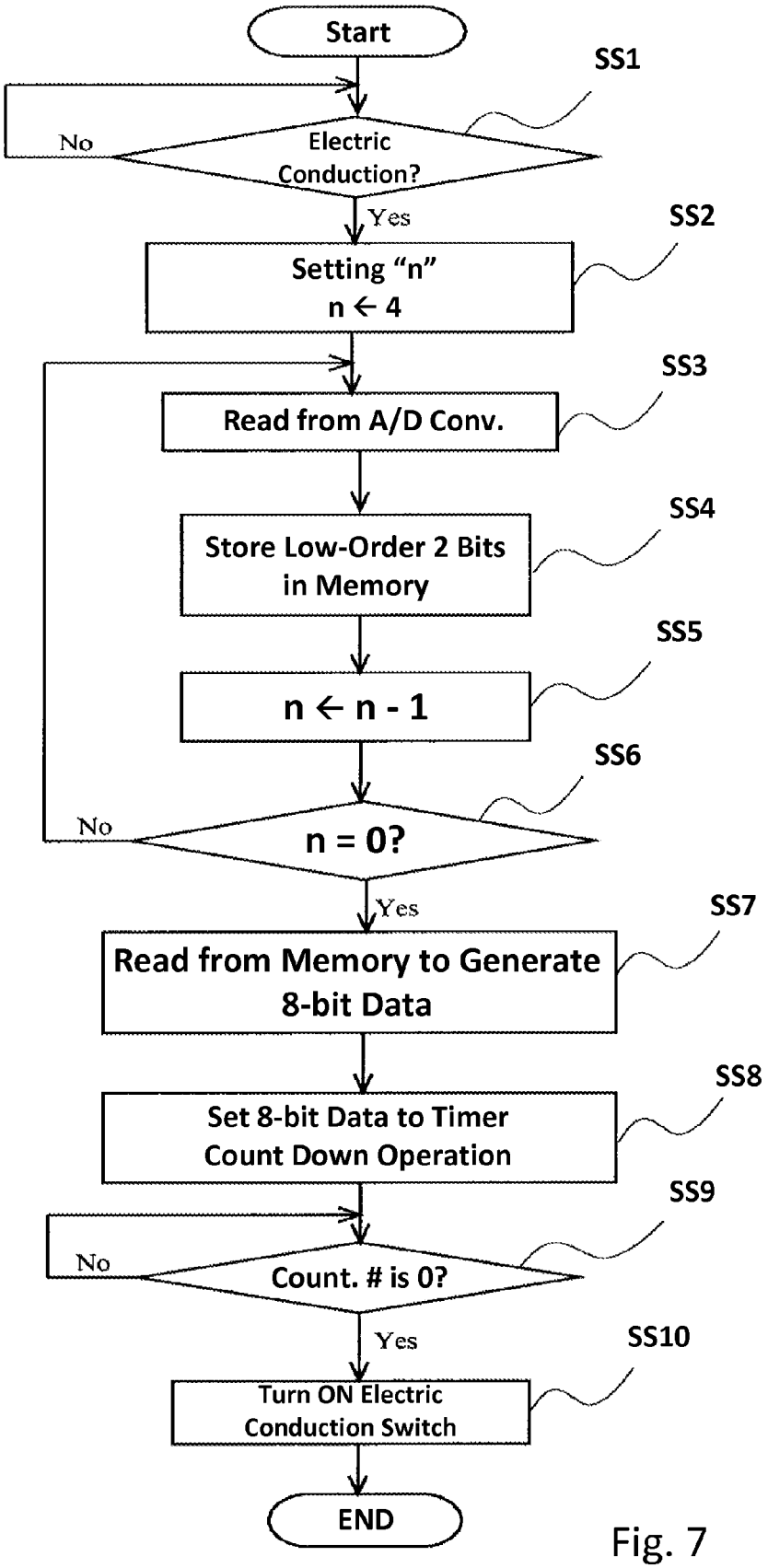
FIG. 7 is a flow diagram that shows control of an electric conduction switch by a control circuit after electric power is supplied.

Next, control of an electric conduction switch 7 after electric power is supplied is explained by using a flow diagram shown in FIG. 7. FIG. 7 is the flow diagram that shows control of the electric conduction switch 7 by the control circuit 20 after the electric power is supplied. As shown in FIG. 7, at first, a stand-by state is maintained until electric conduction starts to be performed to the light emitting element drive device 1 (step SS1). That is, when the electric conduction to the light emitting element drive device 1 is not performed, the control circuit 20 does not operate. This is because the electric power is not supplied to the control circuit 20. When the electric conduction to the light emitting element drive device 1 is performed, the electric power is supplied to the control circuit 20. Therefore, the CPU 21 is ready to execute a program that is stored in a memory. After the electric conduction to the light emitting element drive device 1 is performed, the CPU 21 of the control circuit 20 sets a data read number "n" that is the number of times to read data from the A/D converter 22. For instance, as shown in FIG. 7, the data read number "n" is set to four (4) (step SS2). Next, the CPU 21 of the control circuit 20 reads the data from the A/D converter (step SS3). Then, the CPU 21 stores data of the low-order two (2) bits of the read data that is read from the A/D converter 22 in the memory (step SS4). Further, after the data of the low-order 2 bits is stored in the memory, the CPU 21 subtracts "1" from a value of the data read number "n" (n−1). The subtracted value (n−1) is stored to the memory as a new data read number "n" (step SS5).

Next, whether the read data number "n" is zero (0) (step SS6) is confirmed. When the data read number "n" is not 0 (No at step SS6), the operation goes to step SS3. On the other hand, when the data read number "n" is 0 (YES at step SS6), four data of the low-order 2 bits that are read from the A/D converter 22 are stored in the memory because the reading data is repeated four times ("n"=4). Then, each of the four data is read from the memory so as to generate new 8-bit data (step SS7) (4 data×2 bits=8 bits). More specifically, regarding the four data that are read from the A/D converter 22, for instance, first data of the low-order 2 bits that are read from the A/D converter 22 the first time are assigned to the bit numbers 7, 6 of the new 8-bit data. Note that the far left bit number is 7 (the upper most bit) and the far right bit number is 0 (the lower most bit). Similarly, second data of the low-order 2 bits that are read from the A/D converter 22 the second time are assigned to the bit numbers 5, 4 of the new 8-bit data. Similarly, third and fourth data of the low-order 2 bits that are read from the A/D converter 22 the third and fourth times are respectively assigned to the bit numbers 3, 2 and 1, 0 of the new 8-bit data. As a result, the four data of the low-order 2 bits that are read from the A/D converter 22 generates the new 8-bit data. Further, regarding the generation of the 8-bit data, as an example, the high-order bits of the 8-bit data are assigned in the order of being read from the A/D converter 22 as explained above. However, an order of the generation should not be limit to this embodiment. For instance, as an order of generation of the 8-bit data, the low-order bits of the 8-bit data can first be assigned in the order of being read from the A/D converter 22.

Next, the new 8-bit data is set to the timer 23 as data for configuring a delay time in the CPU 21. After setting the data above, the CPU 21 controls the timer 23 so as to start a count-down operation (step SS8). The timer 23 subtracts a count value from the 8-bit data by a predetermined frequency. The timer 23 performs the count-down operation until a counter value becomes zero (0) (step SS9). When the counter value becomes 0, the timer 23 notifies the counter value of 0 to the CPU 21 (YES at step SS9). After the counter value becomes 0, the CPU 21 outputs the signal S3 from the input and output part 25 toward the electric conduction switch 7. In this case, the signal S3 acts to turn ON the electric conduction switch 7 (step SS10). When the electric conduction switch 7 turns ON, the electric conduction starts (the electric power is supplied).

As explained above, the A/D converter 22 converts a noise component that is included in the power source or the semiconductor device into a digital value. Then, the data for setting the delay time is generated by the low-order n bit of the digital value. That is, a noise component appears at the bit numbers 0, 1 in a digital value if the low-order 2 bits are used. For instance, when 8-bit data for setting a delay time is generated by using low-order 2 bits, four conversion processes are performed by the A/D converter 22. Similarly, when the 8-bit data for setting the delay time is generated by using the least significant bit (the lowest bit), eight conversion processes are performed by the A/D converter 22. Then, the 8 bit data are generated by linking the lowest bits of a digital value that are obtained by the above eight conversion processes. The light emitting element drive device according to this embodiment of the present invention is provided for each device, for example, each lighting device. Therefore, a value of a low-order bit that is output from the A/D converter 22 becomes different among the devices because the low-order bit is composed of a noise component that is different among the devices. As a result, the generated data for setting the delay time is different among the devices.

Further, the control circuit 20 sets a delay time by starting the timer 23 based on this data for setting the delay time. Then, after this delay time passes by, supply of electric power is started by turning ON the electric conduction switch 7. That is, the control circuit 20 maintains the electric conduction switch 7 at an OFF state until this delay time passes. Then, after this delay time passes, the control circuit 20 turns ON the electric conduction switch 7. The signal S3 that performs the turn ON and OFF operations for the electric conduction switch 7 is output from the input and output part 25 of the control circuit 20.

A count number of the timer 23 is set based on the data for setting the delay time. The delay time corresponds to a time counted down by the timer 23 from the initial count number to zero (0) by a clock signal. That is, the delay time is determined by both data for setting the delay time and a frequency of the clock signal of the timer 23. When a count down operation by the timer 23 is finished, the control circuit 20 turns ON the electric conduction switch 7 by the signal S3.

Figure 8A:
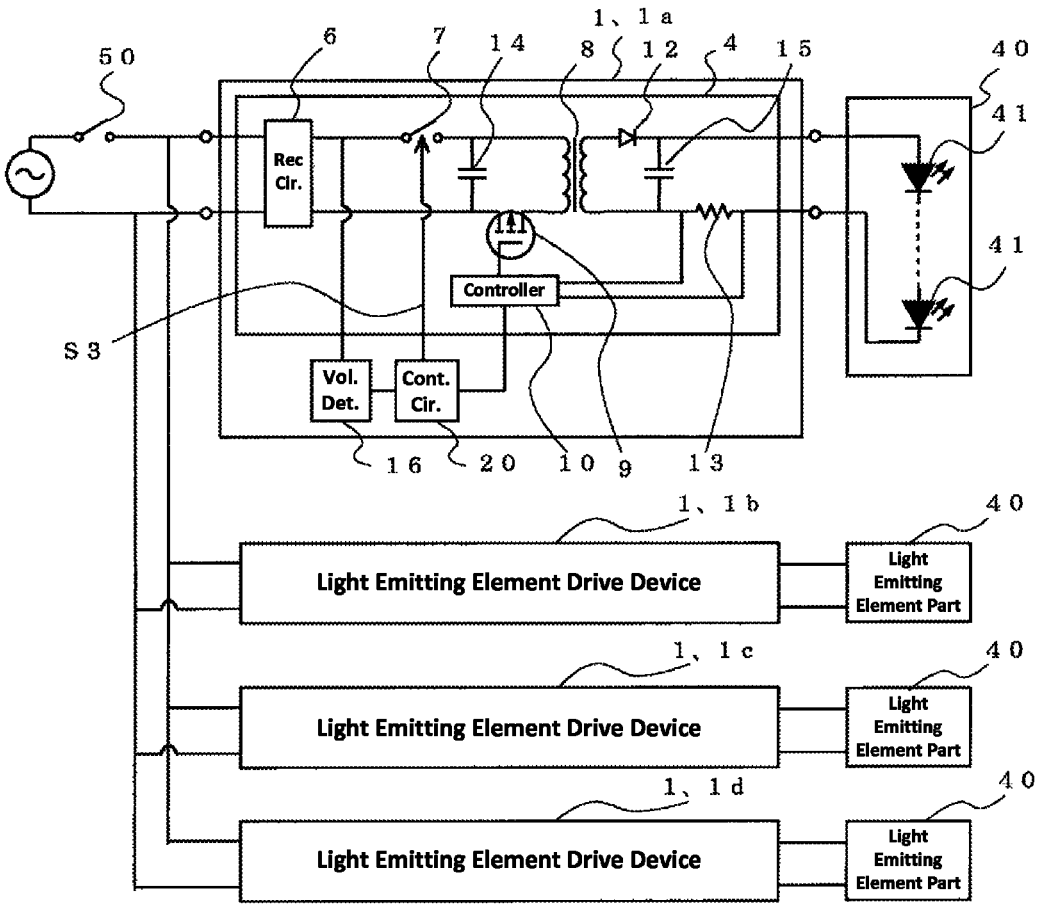
FIG. 8A is a block diagram that shows a configuration of a lighting device that is configured with a plurality of light emitting element drive devices.
Figure 8B:
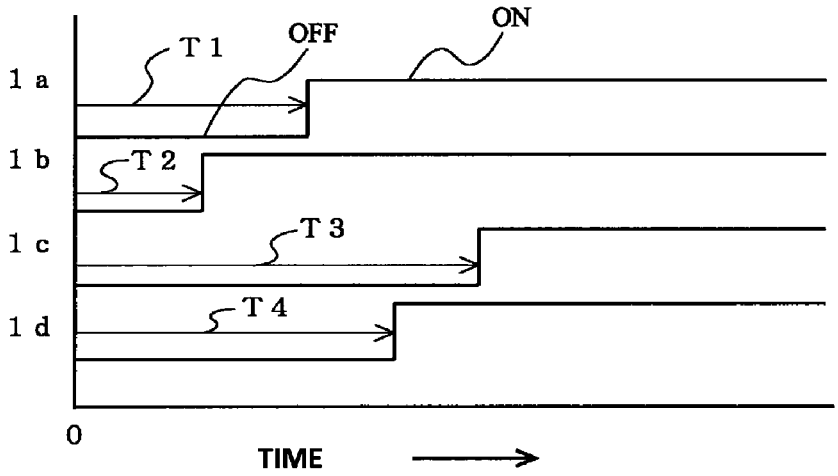
FIG. 8B is a timing diagram that shows an electric conduction state of each of the light emitting element drive devices shown in FIG. 8A as electric power is applied.

Operation of Lighting Device Configured with a Plurality of Light Emitting Element Drive Devices FIG. 8A is a block diagram that shows a configuration of a lighting device that is configured with a plurality of light emitting element drive devices. FIG. 8B is a timing diagram that shows an electric conduction state of each of the light emitting element drive devices shown in FIG. 8A as electric power is applied. As shown in FIG. 8A, the lighting device is configured with a plurality of light emitting element drive devices 1*a*, 1*b*, 1*c* and 1*d*. Each of the light emitting element drive devices 1*a*, 1*b*, 1*c* and 1*d* is connected to the light emitting element part 40. In the lighting device that is configured with the plurality of light emitting element drive devices as discussed above, electric power is supplied to the light emitting element drive devices 1*a*, 1*b*, 1*c* and 1*d* at the same time by turning ON a power supply switch 50. When the light emitting element drive devices 1*a*, 1*b*, 1*c* and 1*d* detect the supplied electric power, data for setting a delay time is determined by the voltage detection circuit 16 and the control circuit 20. Thus, the electric conduction switch 7 is controlled based on the data for setting the delay time. As shown in FIG. 8B, for instance, in the light emitting element drive device 1*a*, the electric conduction switch 7 is turned ON by the control circuit 20 at a time after a delay time T1 passes after the electric power is supplied. Similarly, regarding the light emitting element drive device 1*b*, the same operation as discussed above is performed at a time after a delay time T2 passes after the electric power is supplied. Further, regarding the light emitting element drive device 1*c*, the same operation as discussed above is performed at a time after a delay time T3 passes after the electric power is supplied. Lastly, regarding the light emitting element drive device 1*d*, the operation as discussed above is performed at a time after a delay time T4 passes after the electric power is supplied. In this embodiment, as shown in FIG. 8B, the order of turning ON the light emitting element drive devices 1*a*, 1*b*, 1*c* and 1*d* is as follows: (1) the light emitting element drive device 1*b* (T2); (2) the light emitting element drive device 1*a* (T1); (3) the light emitting element drive device 1*d* (T4); and (4) the light emitting element drive device 1*c* (T3).

As discussed above, when the data for setting the delay time is different in each device, a time for turning ON the electric conduction switch 7 is also different in each device. Therefore, because the data for setting the delay time is set as different data in each device, a time in which a rush current starts to flow is different in each device.

As described above, according to the embodiments of the present invention, there is a time difference between starting the supply of electric power and the start of a rush current in each lighting device, even though the electric power is supplied to a plurality of lighting devices at substantially the same time. As a result, an excessive rush current is prevented from flowing.

In the above embodiments of the present invention, because a value corresponding to a noise component generated at random is used as data (a random number) that is used to determine the delay time for supplying the electric power, a random delay time is generated in each lighting device. Therefore, because a time of actually supplying the electric power (electric conduction) is different in each lighting device even though the electric power is applied to the plurality of lighting device at the same time, the rush current can be decreased. Further, the light emitting element drive devices are configured with the same circuit structures. In addition, it is not necessary to set a different lighting time for each of the lighting devices by adding a special circuit or unit. Therefore, adding and exchanging lighting devices can easily be performed.

The light emitting element drive device and the lighting device according to the embodiments of the present invention can be used not only for a lighting element such as a light emitting diode or an EL (electroluminescence) but also for other loads.

The light emitting element drive device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A light emitting element drive device, comprising:

a power input line to which electric power is supplied;

an electric conduction switch that is provided along the power input line;

a voltage detection unit that detects a power source voltage containing a noise component when the electric power is supplied to the power input line;

a conversion processing unit that converts the detected power source voltage containing the noise component to a digital value;

a data generation unit that generates data of a predetermined number of bits; and a control unit that turns ON the electric conduction switch, wherein the control unit determines a delay time based on the predetermined number of bits of the data, and the delay time corresponds to a time between supplying the electric power to the power input line and turning ON the electric conduction switch, and the control unit turns ON the electric conduction switch after the delay time passes.

2. The light emitting element drive device according to claim 1, wherein the conversion processing unit converts the detected power source voltage to the digital value at least two times so as to obtain a plurality of digital values, and the data generation unit links a low-order "n" bit of each of the plurality of digital values so as to generate the data of the predetermined number of bits, wherein "n" is an integer equal to or greater than 1.

3. A light emitting element drive device, comprising:

a power input line to which electric power is supplied;

an electric conduction switch that is provided along the power input line;

a voltage generation unit that includes a semiconductor device and that generates a voltage containing a noise component when the electric power is supplied to the semiconductor device;

a conversion processing unit that converts the detected voltage containing the noise component to a digital value;

a data generation unit that generates data of a predetermined number of bits; and a control unit that turns ON the electric conduction switch, wherein the control unit determines a delay time based on the predetermined number of bits of the data, and the delay time corresponds to a time between supplying the electric power to the power input line and turning ON the electric conduction switch, and the control unit turns ON the electric conduction switch after the delay time passes.

4. The light emitting element drive device according to claim 3, wherein the conversion processing unit converts the detected voltage to the digital value at least two times so as to obtain a plurality of digital values, and the data generation unit links a low-order "n" bit of each of the plurality of digital values so as to generate the data of the predetermined number of bits, wherein "n" is an integer equal to or greater than 1.

5. The light emitting element drive device according to claim 3, wherein the semiconductor device is a Zener diode.

6. A lighting device, comprising:

a power source;

first and second light emitting element units; and first and second light emitting element drive devices according to claim 1 to which electric power from the power source is applied at the same time, wherein the first and second light emitting element units are electrically connected to the first and second light emitting element drive devices, respectively, and a first delay time controls a first turning ON operation of the first light emitting element unit, and a second delay time controls a second turning ON operation of the second light emitting element unit, and the first delay time is different from the second delay time so that the electric power is supplied to each of the first and second light emitting element units at a different time.

7. A lighting device, comprising:

a power source;

first and second light emitting element units; and first and second light emitting element drive devices according to claim 3 to which electric power from the power source is applied at the same time, wherein the first and second light emitting element units are electrically connected to the first and second light emitting element drive devices, respectively, and a first delay time controls a first turning ON operation of the first light emitting element unit, and a second delay time controls a second turning ON operation of the second light emitting element unit, and the first delay time is different from the second delay time so that the electric power is supplied to each of the first and second light emitting element units at a different time.

* * * * *